United States Patent [19]

Horváth et al.

[11] 4,365,790

[45] Dec. 28, 1982

[54] PLANT FOR PRODUCING ENAMELED WIRE USING AN INLINE PROCESS

[75] Inventors: Miklos Horváth; Hans-Peter Pichler, both of Graz, Austria

[73] Assignee: Mag Maschinen und Apparatebau Gesellschaft mbH, Graz, Austria

[21] Appl. No.: 265,125

[22] Filed: May 19, 1981

[51] Int. Cl.[3] ..... C23D 9/00

[52] U.S. Cl. ..... 266/103; 266/87; 118/65; 118/620; 72/286; 148/156; 432/8

[58] Field of Search ..... 266/103, 87, 88; 72/286, 46; 432/8, 59, 48; 148/156; 118/65, 620

[56] References Cited

U.S. PATENT DOCUMENTS

| | | | |
|---|---|---|---|
| 3,106,386 | 10/1963 | Harris | 266/103 |
| 3,351,329 | 11/1967 | Thomas | 432/8 |
| 3,596,634 | 8/1973 | Fuchs | 118/65 |
| 3,710,756 | 1/1973 | Goyffon | 118/61 |
| 3,810,736 | 5/1974 | Dumas | 432/8 |
| 3,842,643 | 10/1974 | Large et al. | 72/286 |

*Primary Examiner*—L. Dewayne Rutledge
*Assistant Examiner*—Christopher W. Brody
*Attorney, Agent, or Firm*—Beveridge, DeGrandi & Kline

[57] ABSTRACT

A plant for producing enameled wire using an inline process has, placed in order a wire pay-off system, a wire drawer, an annealer, an enameled dope coater, an enamel processing unit and an enameled wire take-up unit. The annealer and the dope coater are placed together in a single oven housing, which has a drying space, a curing space and a return shaft in which a circulating air blower, a heating unit and a catalyst are placed. The blower is responsible for producing a heated air current moving through the heating unit of the annealer and through the catalyst, the air current furthermore moving in the opposite direction to the direction of the wire through the curing space and the drying space. The wire makes its way through an annealing tube and the return shaft into waste gas pipe joined therewith and through a wire cooler, which is full of inert atmosphere as produced by a unit. After coming out of the wire cooler the wire is moved into the enamel dope coater from which it makes its way into the drying space and the curing space, it coming out of the curing space through a wire outlet and then makes its way into a wire cooler which is right next to the oven housing. From the wire cooler the wire makes its way to the wire take-up system, after being run through plant a number of times. The cooling air for the wire cooler is preheated by a heat exchanger before going into the curing space under gage pressure. Control of air circulation is undertaken by adjustment of the speed of the blower and adjustment of the door, while the temperatures for drying and baking are controlled by the waste gas door.

17 Claims, 2 Drawing Figures

PLANT FOR PRODUCING ENAMELED WIRE USING AN INLINE PROCESS

BACKGROUND OF THE INVENTION

The present invention is with respect to a plant for producing enameled wire using an inline process having, for processing wire coming from a wire pay-off system, one after the other a wire drawer, a bare wire annealer, an enamel dope coater, an enamel processing unit and an enameled wire take up unit.

A plant designed on these general lines is to be seen in British Pat. No. 1,305,032 or the parallel German specification 2,058,151. In the case of this inline plant the wire coming from the wire drawer makes its way over guide rollers through a tempering unit or annealer, where it is annealed for freeing it of stresses, that is to say normalized, before running into an enameling system, as the next part of the plant, in which the wire is given a number of coatings of enamel dope which is then baked.

Even although this form of inline process may be looked upon as giving useful effects in view of continuously automated wire processing systems, because, as well as other useful effects, the production rate is increased and costs lowered while the quality of the wire produced is better than in the prior art, there are a number of shortcomings in connection with the process, more specially in connection with a higher power need, undesired effects on the environment caused by chemicals from the plant. Suggestions for better designs have been made more specially in connection with the enameling system, such suggestions being more importantly in connection with cutting down the power need in this system and sealing off the wire inlets and outlets. For example a suggestion has been made in the past for burning solvent vapors and products of cleavage in an output catalyst unit, such vapors and products being produced when the bare wire, heated by radiant heaters is coated with the dope. When such burning takes place the heated air produced may be used for drying and curing the dope coating on the wire. One useful effect of catalytic burning or combustion is that the energy of the solvents may be used for drying the dope coating and baking it, while on the other hand the amount of undesired chemicals given off into the environment is cut back.

However, because the need for saving power is becoming more and more important and laws made by public authorities for protection of the environment are becoming tighter and harder to keep to, such suggestions do not go far enough. Furthermore these suggestions do not take into account the question of space taken up by the plant.

GENERAL OUTLINE OF THE INVENTION

For this reason one purpose of the present invention is that of making such a better design of a plant of the sort noted that the power or energy need of the plant seen generally is greatly decreased and undesired effects on the environment by chemicals is cut down as far as possible. A further purpose of the present invention is to make it possible for the plant, once it had been started up, to be so automated that it is automatically controlled under the given conditions so that generally speaking no attention is needed on the part of the workers running the plant. One outcome of this will be that the upkeep work, if desired, may be done in the day shift while on the other hand wire speeds are increased and the price of production lowered.

For effecting this purpose and other purposes in the invention the annealer for the drawn bare wire and the enamel processing unit are placed in a common oven housing as a single processing stage and the oven housing has a retort with a drying space and, next to it, a curing space, together with a return shaft for the circulation shaft for circulation of a hot air current using a blower in a single counter-current with respect to the moving wire. In the plant of the present invention the hot air makes its way in the opposite direction to the wire, that is to say in counter-current thereto, through the drying space and the curing space. The transfer of heat to the wire takes place mostly be convection and because of this and because of the counter-current effect takes place at a very high rate, the solvents given off by the dope are cleared very quickly. Because of this the conditions are kept to for running the plant with a high wire speed. The plant or circulating air mixed with the solvents comes out of the retort right next to the wire inlet and, under the effect of a circulating air blower, is moved through the return shaft to a point near the wire outlet back into the retort. If the plant is designed with more than one wire run, the blower is best designed as a transverse flow blower. Some of the plant or circulating air is moved through waste gas pipe, which is branched off from a point downstream from the catalyst and is best joined up at the end wall of the common oven housing, so that the air then makes its way out into the free atmosphere and an amount of unused air from the atmosphere, equal in amount to the waste air, is aspirated at the wire inlet or wire outlet into the retort. In the return shaft there is an electrical heating system for heating up the oven and a catalyst is present used for burning the organic solvents in the plant air. Because the air is circulated back into the retort, the energy of the solvent is made use of for the dope drying and baking process. A high wire speed will make it possible for a great enough amount of solvent to be run into the retort so that the oven, in steady state operation, will be self-supporting, that is to say without any need for electrical power. The heat produced on catalytic burning of the solvent vapors and products of cleavage present in the plant or circulating air, is not only used for self-supporting operation of the plant, but furthermore for heating up the air in a first stage of heating, which is forced under gage pressure into the plant at the wire outlet and furthermore for producing steam, which is used as an inert atmosphere. In the waste gas pipe a second catalyst is placed by which the level of undesired chemical substances in the waste gas is so cut back that there are generally speaking no undesired effects on the environment.

For decreasing the level of undesired chemicals which would make the plant unhealthy for the workers running it, a further useful effect may be produced if steps are taken to see that there is no chance of undesired chemicals being given off at the wire inlets and outlets of the oven housing into the atmosphere. For doing this, the pressure conditions at the wire inlet into the oven are controlled for producing this effect, that is to say by producing a suction effect at the wire inlet by the circulating air blower placed near the inlet, such suction effect taking effect in a suction inlet pipe so that air from the atmosphere is aspirated into the plant. Furthermore at the dope coating system and the wire inlet there is a box which is joined up closely with the oven housing and is used to make certain that any solvent vapors which may come out of the dope coating system are mixed with the air aspirated from the atmosphere and forced into the oven. For this reason at this point no poisonous gases are let off into the outside atmosphere. Furthermore at the wire outlet by using a wire cooler placed right next to the outlet, and a gage pressure and aspiration blower a differential pressure is produced in the wire cooler which is greater than the pressure within the curing space at the wire outlet so that at this point as well heated, so far unused air from the atmosphere makes its way into the curing space, this stopping undesired waste gases from coming out of the system. Because of the catalytic burning of the hydrocarbons damaging organic solvents are burned to carbon dioxide and water, compounds which do not have any undesired effects on men, while at the same time heat is produced in an amount dependent on the heating value of the hydrocarbons.

LIST OF FIGURES

Further useful developments of the plant of the invention will be seen in the dependent claims.

In the figures a preferred working example of the invention is to be seen diagrammatically.

DETAILED ACCOUNT OF WORKING EXAMPLE OF THE INVENTION

Figure 1:
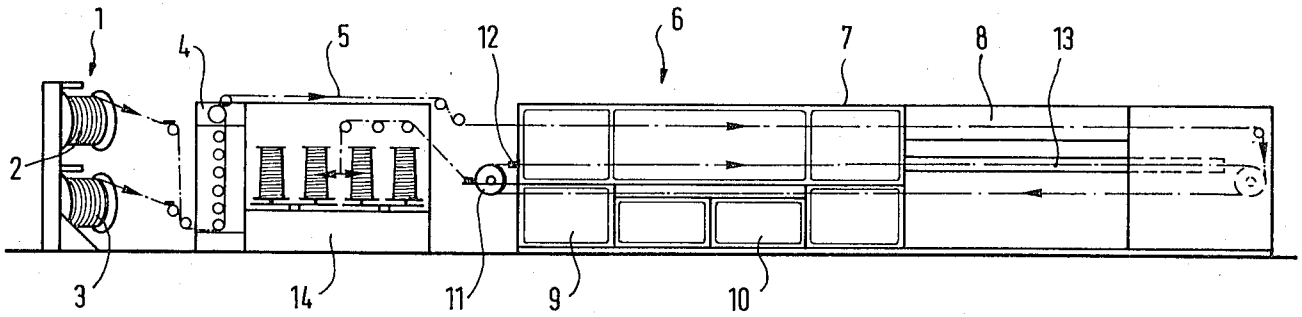
FIG. 1 is a diagrammatic view of the plant generally.

The plant, to be seen generally and diagrammatically in FIG. 1, is made up of the wire pay-off system 1 with two wire bobbins 2 and 3, from which the wire is pulled through the next part of the plant, that is to say the wire drawer 4. Running over guide rollers the drawn-bare wire 5 makes its way in the direction of the arrows into the enameling unit 6, in whose oven housing 7 there is an annealer 8 forming part of this unit. In the lower part there is a dope vessel 9 and the control system 10. The wire making its way from the wire drawer is moved through the annealer in the top part of the oven housing 7, changed in direction at the back end and then moved back to the upstream end of the oven housing, at which point the wire is moved by the guide roller 11, by way of the dope coater 10 into the enameling unit at the wire inlet and when the wire comes out of the wire cooler 13 it is moved back again by way of a guide roller. This operation takes place a number of times till the coating on the wire is thick enough. The wire is then taken up by its bobbin in the wire take-up apparatus 14.

Figure 2:
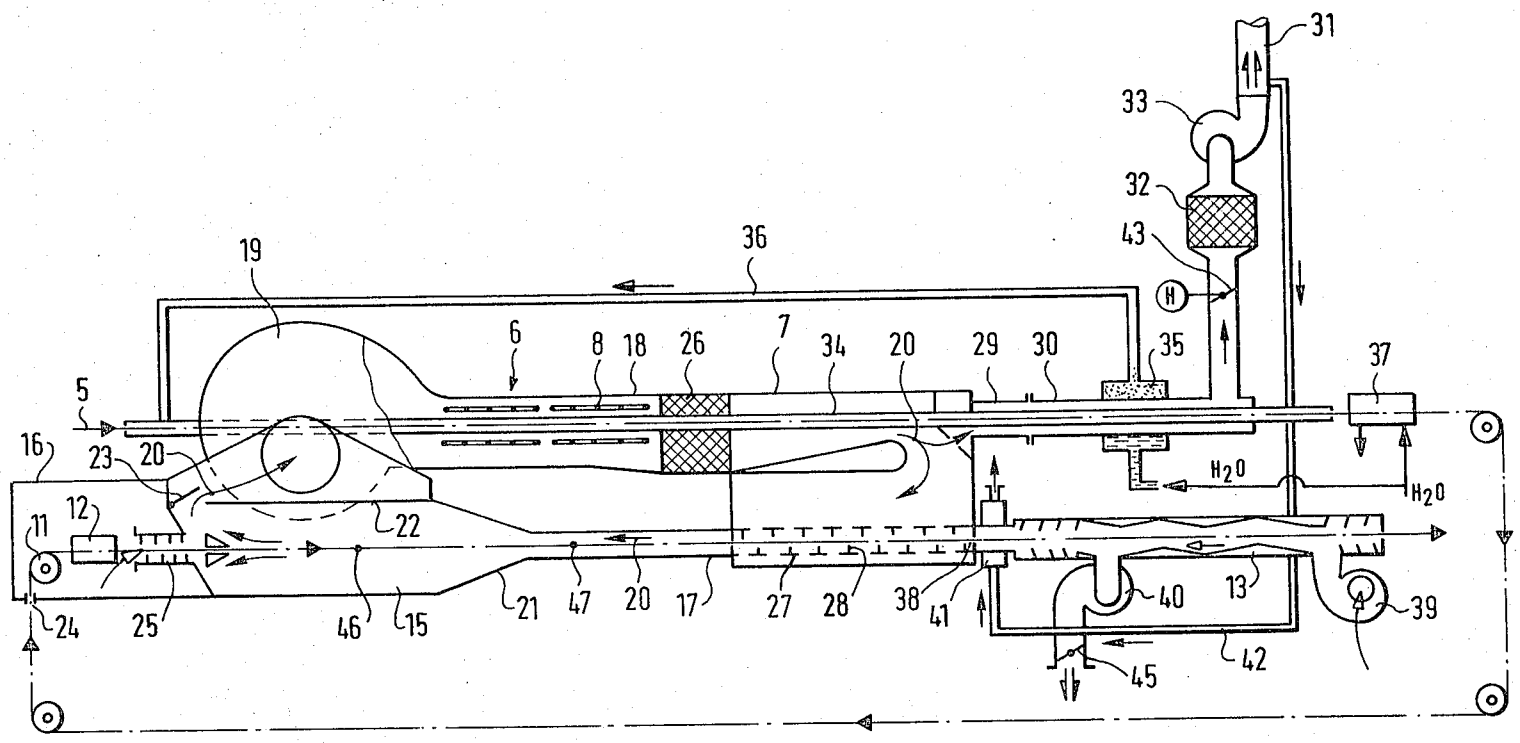
FIG. 2 is a diagrammatic section view through the common oven housing and the annealer united therewith.

More details of this part of the plant will be seen in FIG. 2. Here it is possible to see the oven housing 7, which in a lower part has a drying space 15, a curing space 17, in which the dried dope coating on the wire or enamel is baked, and a return shaft 18. At the left hand end of the return shaft there is a blower 19 for plant air which has the effect of keeping up an air circulation in a single circuit counter current as marked by arrow 20 so that the air circulation takes place within the drying room 15 and the curing room 17 in the opposite direction to the direction of the wire 5.

The drying room 15 and the curing room 17 are joined together by way of an airway 21 becoming broader towards the drying room on the inlet end or side with the outcome that the air current is slowed down and made more regular. In a separating wall 22 between the plant air blower 19 and the drying room 15 there is an air door 23 with which the air current and for this reason the new air from the atmosphere making its way through the suction inlet pipe 25 may be controlled.

The plant air is heated in the return shaft when the plant is being started up not only by the heating unit of annealer 8 but furthermore by catalyst 26, in which the solvent vapors and products of cleavage coming from the dope on the wire 5, are burned. The hot plant air then makes its way in part into current space 17, it making contact with wire 5 by way of a sleeve 27 with openings. Sleeve 27, which is only to be seen diagrammatically in FIG. 2, has inwardly running plates 28, placed at a right angle, such plates being placed in the form of a labyrinth so that strong turbulence is produced in the hot air, this making certain of a high level of effect by the air on the wire 5.

Part of the hot plant air makes its way through the catalyst 26 at the front end of the oven housing by way of an outlet pipe 29 into waste gas pipe 30, in which a second catalyst 32 is placed, the air making its way to a waste air blower 33 from which it makes its way into the free atmosphere.

Not only the return shaft 18 but furthermore the outlet pipe 29 and the waste gas pipe 30 have an annealing tube 34 running through them in an axial direction, the wire 5 being moved through the tube 34. An inert atmosphere as produced by a steam producer 35 (heated by the waste gas pipe 30) is used to make certain that steam, used as an inert atmosphere, may make its way by way of steam line 36 into the inlet end of annealing tube 34.

To the right hand side of waste gas pipe 30 there is a wire cooler 37 in which the wire, annealed so as to be free of stresses, is cooled before by way of different guide rollers and after being moved through the dope coater 12 and the aspiration pipe 25 it makes its way into the drying space 15.

The dope coating apparatus is placed within a box 16, which in its lower part has an inlet opening 24, by way of which wire is able to make its way into box 16. The purpose of this box is to make certain that any solvent vapors coming from the dope coating apparatus 12 are well mixed with new air from the atmosphere and such mixture so produced may be aspirated through inlet pipe 25 into the drying space 15. For this reason poisonous vapors are not, at this point, able to make their way into the atmosphere.

The wire comes from curing space 17 to wire outlet 38 which is right next to the wire cooler 13, which has a gage pressure blower 39 and an aspiration blower 40 which may be used for adjustment of a differential pressure in the wire cooler so that at the wire outlet 38 a gage pressure is produced in the wire cooler 13 and furthermore atmospheric air may be taken up through the wire outlet into the curing space 17, this stopping any undesired organic chemicals making their way into the free atmosphere.

The air under pressure moving through the wire outlet 38 into the curing space 17 is pre-heated by heat exchanger 41 which is heated by hot waste gases by way of line 42 coming from waste gas line 31.

For controlling the waste gas a controlling door 43 is placed in the waste gas pipe 30 and lastly in the pipe connection of aspiration blower 40 there is a further door 45 with which the gage pressure ratio in the wire cooler and for this reason the amount of air from the atmosphere making its way at 38 to the oven may be controlled.

Although in the diagrammatic FIG. 2 only a system for guiding one wire is to be seen, it will naturally be possible for a number of wire runs to be placed side-by-side running through the plant. To this end more than one annealing tube 34 may be placed side-by-side in the return shaft 18.

The function of the plant of the invention will now be quite clear in view of the observations made so far. The wire, pulled from the wire pay-off system with the bare wire bobbin by the wire drawer over brush wheels, makes its way into the bare wire annealing tube in question. Steam as an inert atmosphere for stopping oxidation of the wire surface is let into the annealing tubes. After annealing has been completed, the wire is cooled down in wire cooler 37, which is generally made up of a cooling tube, into which water is pumped in the opposite direction to the direction of the wire. When the wire comes out of wire cooler 37 any water still on the wire is cleared by blowing so that the wire is run over the next guide roller in a dry condition.

The wire is coated with enamel dope in the coating apparatus, more dope than is necessary being put on, the unnecessary dope which is greater than the amount needed, is stripped off with nozzles to get the desired dope thickness. Furthermore, for producing this even coating a rate controlling system may be used for putting the desired amount of dope on by using a measuring pump and felts, over which the wire is moved. The nozzles used in this respect may have a metallic core or a diamond core, diamond cores or dies being better because of their longer working life. Because for the high wire speeds it is necessary for the dope only to be put on in thin coatings which may be dried more quickly and because furthermore a greater number of dope coatings makes the enamel insulation more even round the wire, the dope coating is designed for producing more than one dope coating. Furthermore it is so designed that if the wire is snapped,, the supply of dope is automatically shut down. In drying space 15 the dope coatings are dried using the smooth hot air current moving over the wires. The wire with the dried dope makes its way by way of airway 21 in counter-current thereto as far as the curing space 17, where the dried dope is baked with very hot plant air in such a way that, using the open work or perforated sleeve 27 of the present invention a very strong effect of the plant air on the wire is made certain of. On coming out through the wire outlet 38, the wire is taken up in a wire cooler 13 coming next and from this point, after being run through the plant a number of times, makes its way to the next part of the plant, that is to say the take-up apparatus 14 for the enameled wire.

The air circulation system may undergo adjustment to be in harmony with the needs of baking by using the variable speed plant air blower 19 and the door 23.

After the heating operation has been completed automatic control of the drying and baking temperature is undertaken by door 43 with the help of temperature feelers such as thermoelectric elements, with the outcome that the plant is self-supporting, that is to say not dependent on the supply of energy or power from the outside. Such thermoelectric elements are placed for example at points 46 and 47. It will be quite clear that by adjustment of door 43 the air rate may be controlled, such rates being for example the rates at points 25 and 38 in the oven housing, at which air is aspirated from the atmosphere or air is let off by way of blower 33 or the heat exchanger 41 into the atmosphere.

We claim:

1. In a plant for producing enameled wire using an inline process for processing wire coming from a wire pay-off system, having in order, a wire drawer, a bare wire annealer, an enamel dope coater, an enamel processing unit and an enameled wire take-up unit, wherein the improvement comprises the plant having a common oven housing within which the bare wire annealer and the enamel processing unit are placed as single processing stage, a retort, structures having within them a drying space and jointed thereto a curing space, a return shaft and a blower for blowing hot air current in a single circuit in counter current with respect to said wire.

2. The plant as claimed in claim 1 wherein said annealer is positioned within said return shaft.

3. The plant as claimed in claim 1 having at a downstream end of said return shaft an outlet connection pipe with a waste gas pipe joined with said housing, the waste gas pipe being placed round part of the annealer.

4. The plant as claimed in claim 3 wherein in the return shaft the plant has at least one annealing tube running through the shaft lengthways and through the waste gas pipe, and a system for guiding drawn bare wire through said annealing tube.

5. The plant as claimed in claim 1 having in the curing space of the oven housing a sleeve, made of sheet metal with openings, the sleeve having inwardly running labyrinth-like plates, through which the coated wire is moved.

6. The plant as claimed in claim 5 in which the sleeve is placed at a mixing point between air circulated within the plant and air taken from the outside atmosphere, that is to say more specially between the curing space and a wire outlet.

7. The plant as claimed in claim 6 having a wire cooler placed next to the wire outlet from the oven housing, and furthermore an aspiration blower as part of the wire cooler, such aspiration blower being responsible for producing a differential pressure in the wire cooler so that a controlled excess of air may be forced into the oven housing at the wire outlet.

8. The plant as claimed in claim 7 wherein the wire cooler is joined up directly with the sleeve.

9. The plant as claimed in claim 8 characterized in that at the wire outlet at the wire cooler connection there is a heat exchanger for pre-heating air under pressure making its way into the oven housing.

10. The plant as claimed in claim 3 having a steam producer, heated by the waste gas pipe, and a steam pipe of the steam producer, such steam pipe being joined up with the annealing pipe for letting steam into the same.

11. The plant as claimed in claim 3 having in the waste gas pipe a catalyst for burning off any solvent still present.

12. The plant as claimed in claim 1 wherein the dope coater is placed within a box for clearing solvent vapors produced by the dope coater.

13. The plant as claimed in claim 1 having an air controller with which air inlet and outlet paths of the common oven housing are controlled for keeping to an unchanging level of the drying and curing temperatures.

14. The plant as claimed in claim 13 wherein the air controller takes the form of a mechanically moved door.

15. The plant as claimed in claim 13 or claim 14 having temperature feelers for temperature controlled operation of the door.

16. The plant as claimed in claim 15 wherein the temperature feelers are placed in the drying and curing zone.

17. The plant as claimed in claim 15 wherein the temperature feelers take the form of thermoelectric elements.

* * * * *